US010463892B2

(12) United States Patent
Goeltz

(10) Patent No.: US 10,463,892 B2
(45) Date of Patent: Nov. 5, 2019

(54) RESCUE CAGE, AND HOISTING RESCUE VEHICLE EQUIPPED THEREWITH

(71) Applicant: Rosenbauer International AG, Leonding (AT)

(72) Inventor: Berthold Goeltz, Steinweiler (DE)

(73) Assignee: Rosenbauer International AG, Leonding (AT)

( * ) Notice: Subject to any disclaimer, the term of this patent is extended or adjusted under 35 U.S.C. 154(b) by 157 days.

(21) Appl. No.: 15/512,194

(22) PCT Filed: Sep. 16, 2015

(86) PCT No.: PCT/AT2015/050232

§ 371 (c)(1),
(2) Date: May 16, 2017

(87) PCT Pub. No.: WO2016/040978

PCT Pub. Date: Mar. 24, 2016

(65) Prior Publication Data

US 2017/0252583 A1 Sep. 7, 2017

(30) Foreign Application Priority Data

Sep. 18, 2014 (DE) ..... 10 2014 013 898

(51) Int. Cl.
*A62B 1/02* (2006.01)
*B66F 11/04* (2006.01)
(Continued)

(52) U.S. Cl.
CPC ..... *A62B 1/02* (2013.01); *B66F 11/044* (2013.01); *B66F 11/046* (2013.01); *E06C 5/04* (2013.01);
(Continued)

(58) Field of Classification Search
CPC ..... A62B 1/02; A62C 27/00; B66F 11/044; B66F 11/046; B66F 11/04; E06C 5/04;
(Continued)

(56) References Cited

U.S. PATENT DOCUMENTS 3,563,205 A * 2/1971 Vail ..... A01K 31/14 119/429
3,584,703 A * 6/1971 Lane ..... B66F 11/044 182/127
(Continued)

FOREIGN PATENT DOCUMENTS

DE 3 929 959 C1 11/1990
DE 10 2004 058 188 A1 6/2006
(Continued)

OTHER PUBLICATIONS

ESPACE net Bibliographic Date—1 page—downloaded May 2019 (Year: 2019).*
(Continued)

*Primary Examiner* — Katherine W Mitchell
*Assistant Examiner* — Shiref M Mekhaeil
(74) *Attorney, Agent, or Firm* — Collard & Roe, P.C.

(57) ABSTRACT

The invention relates to a rescue cage (4) for a hoisting rescue vehicle (1) having a turntable ladder (3), comprising a cage base (5), a cage barrier (6) and at least one column-type support element (7) that projects from the cage base (5) and is located in the outer peripheral region of the cage base (5). A first receiving device (15) is arranged or formed on the cage base (5) in the area of the support element (7). On the side facing the cage base (5), the support element (7) includes a first connecting element (16) that is connected to the first receiving device (15) in such a way as to be detachable as required. The invention further relates to a
(Continued)

Figure 1:
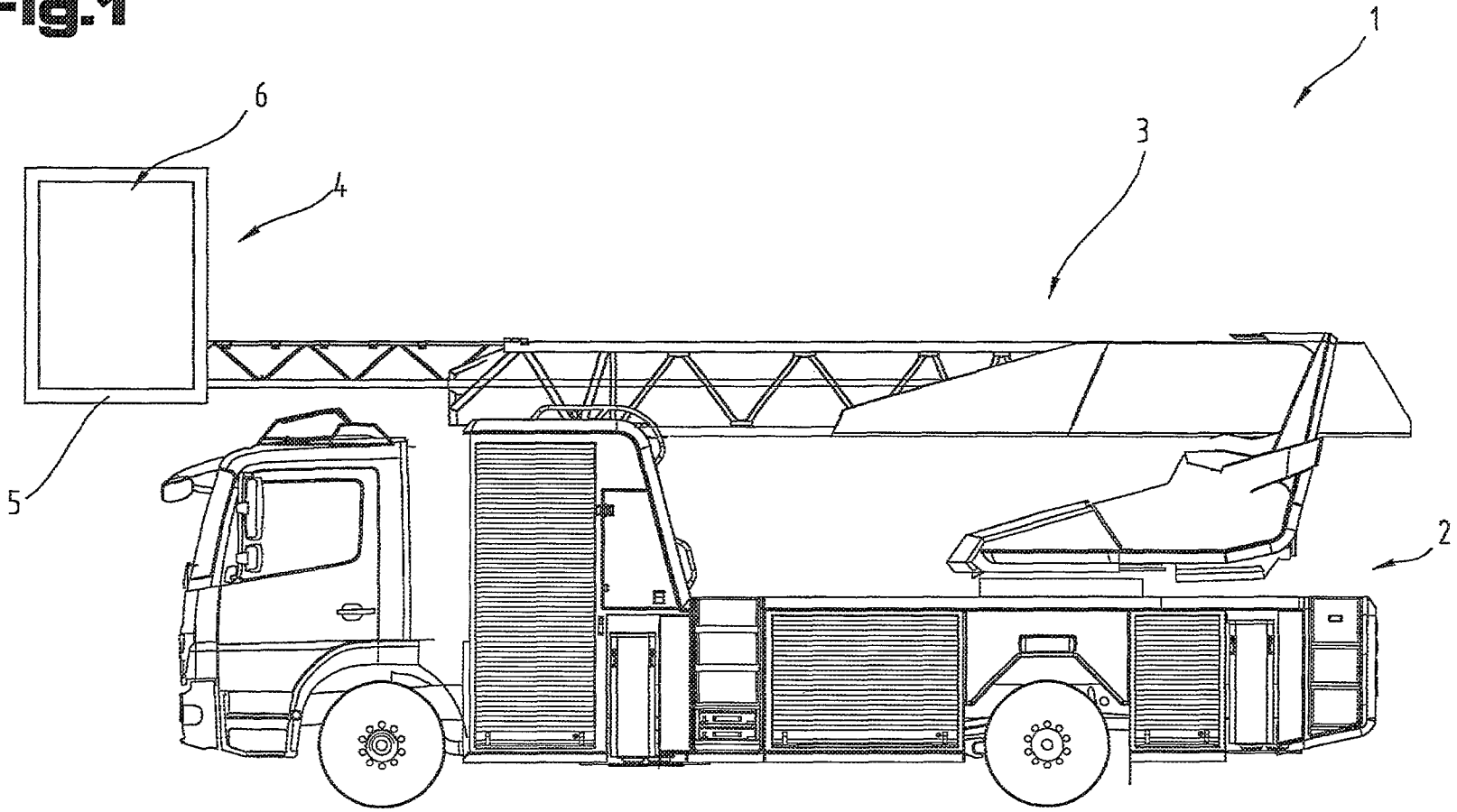

hoisting rescue vehicle (1) equipped with a rescue cage (4) of said type as well as a person holding unit.

14 Claims, 9 Drawing Sheets

(51) Int. Cl.
*E06C 5/04* (2006.01)
*A62C 27/00* (2006.01)
*E06C 7/16* (2006.01)

(52) U.S. Cl.
CPC ..... *A62C 27/00* (2013.01); *B66F 11/04* (2013.01); *E06C 7/16* (2013.01)

(58) Field of Classification Search
CPC .. E06C 7/16; E04G 5/14; E04G 5/141; E04G 5/144; B65G 69/30
See application file for complete search history.

(56) References Cited

U.S. PATENT DOCUMENTS 3,995,833 A * 12/1976 McLaughlin ..... E04G 21/3233 256/59
4,022,337 A * 5/1977 Eichenhofer ..... B60R 3/00 414/541
4,346,487 A * 8/1982 Holdt ..... A47C 20/043 5/617
5,444,880 A * 8/1995 Weismiller ..... A61G 7/015 5/424
5,535,964 A * 7/1996 Ahlsten ..... B64D 9/00 244/118.5
5,586,423 A * 12/1996 Mullen ..... E04B 1/4121 182/45
5,617,931 A * 4/1997 Zygmun ..... E04G 3/30 182/145
5,938,283 A * 8/1999 Babcock ..... A47C 3/0255 297/273
6,038,829 A * 3/2000 Franks ..... E04G 3/26 52/645
6,085,867 A * 7/2000 Daniel, III ..... E04F 11/112 182/113
6,145,619 A * 11/2000 Risser ..... B66F 11/044 182/113
6,585,080 B2 * 7/2003 Murray ..... E04G 21/3233 182/45
6,595,559 B1 * 7/2003 Readman ..... F16L 13/10 285/371
6,887,028 B1 * 5/2005 Kirla, Jr. ..... B60P 1/435 14/69.5
7,306,548 B2 * 12/2007 Martin ..... A63B 21/00065 297/5
7,478,445 B2 * 1/2009 De Vries ..... A61B 6/0442 5/601
8,371,427 B1 * 2/2013 Miklos ..... B65G 69/30 193/35 A
8,925,904 B2 * 1/2015 Christoffer ..... E04H 17/22 182/113
9,089,728 B2 * 7/2015 Halley ..... A62C 27/00
2002/0153201 A1 * 10/2002 Warford ..... E04F 11/025 182/115
2003/0213072 A1 * 11/2003 Myrick ..... B60P 1/43 14/69.5
2004/0107519 A1 * 6/2004 Grody ..... A61G 3/061 14/69.5
2004/0155126 A1 * 8/2004 Jenkins ..... B08B 17/00 241/24.11
2004/0262079 A1 * 12/2004 Bailey ..... B66C 23/36 182/2.3
2005/0236226 A1 * 10/2005 Salmi ..... E06C 5/04 182/65.1
2006/0010672 A1 * 1/2006 Kuenzel ..... E04G 21/3233 29/284
2006/0018744 A1 * 1/2006 Luciano ..... B60P 3/125 414/563
2006/0059636 A1 * 3/2006 Suggate ..... E04F 11/002 14/69.5
2010/0066069 A1 * 3/2010 Bradshaw ..... B60R 9/06 280/769
2010/0200332 A1 * 8/2010 Bowden ..... B66F 11/04 182/113
2010/0276227 A1 * 11/2010 Fuqua ..... B66F 11/044 182/63.1
2011/0036662 A1 * 2/2011 Smith ..... E04G 1/36 182/37
2012/0006619 A1 * 1/2012 DuBose ..... B60P 1/00 182/113
2013/0015016 A1 * 1/2013 Honeycutt ..... E04F 11/025 182/113
2014/0319298 A1 * 10/2014 O'Regan ..... B60R 9/00 248/224.7
2014/0356090 A1 * 12/2014 Cardona ..... A61G 3/0808 410/3
2014/0367195 A1 * 12/2014 Melton ..... E04G 1/34 182/113
2015/0352916 A1 * 12/2015 Towner ..... B60P 3/125 414/800
2017/0275888 A1 * 9/2017 Honeycutt ..... E04F 11/035

FOREIGN PATENT DOCUMENTS

DE 20 2006 019106 U1 4/2008
DE 202006019106 * 5/2008 ..... A61G 1/00
DE 20 2010 008990 U1 4/2011
EP 2 374 749 A1 10/2011
JP 11113960 A * 4/1999
JP 2003 104698 A 4/2003
WO 2009/053047 A1 4/2009

OTHER PUBLICATIONS

English translation of DE202006019106—4 pages—downloaded May 2019 (Year: 2019).*
Drawings from DE202006019106—2 pages—downloaded May 2019 (Year: 2019).*
English translation of claims from DE202006019106—3 pages—downloaded May 2019 (Year: 2019).*
International Search Report of PCT/AT2015/050232, dated Mar. 31, 2016.

* cited by examiner

RESCUE CAGE, AND HOISTING RESCUE VEHICLE EQUIPPED THEREWITH

CROSS REFERENCE TO RELATED APPLICATIONS

This application is the National Stage of PCT/AT2015/050232 filed on Sep. 16, 2015, which claims priority under 35 U.S.C. § 119 of German Application No. 10 2014 013 898.4 filed on Sep. 18, 2014, the disclosure of which is incorporated by reference. The international application under PCT article 21(2) was not published in English.

The invention relates to a rescue cage for a hoisting rescue vehicle, in particular a firefighting vehicle having a turntable ladder, comprising a cage base, a cage barrier and at least one in particular column-type support element that projects from the cage base, which at least one support element is located in the outer peripheral region of the cage base. The invention further relates to a hoisting rescue vehicle equipped with a rescue cage of said type.

EP 2 374 749 A1 describes a rescue cage for firefighting, comprising a suspension for connecting the rescue cage to one end of a ladder. The rescue cage comprises a cage base and a cage barrier fixedly connected to the cage base which is disposed in at least the region of a cage front end, in the region of a left-hand and right-hand cage side and in the region of a cage rear end. The cage barrier is also permanently connected to the cage base and has column-type uprights. Cladding elements are mounted on at least certain regions of the uprights. A gap is provided in the cage barrier in the region of the cage rear end, which can be closed by means of a safety bar at the height of a handrail. Provided in the cage base is a recess with a large surface area and an underfloor module can be pushed from the rear end of the rescue cage and inserted in the recess and is connected to the suspension so that it can be connected to the ladder. When positioned in the recess, the underfloor module forms a part of the cage base serving as a support surface for a person present in the rescue cage. Pivoting doors are also provided on the underfloor module in the region of the cage rear end, which are mounted on other uprights extending out from the underfloor module so as to be pivotable. The other uprights are fixedly connected to the underfloor module. At the cage front end, the cage barrier has an additional front panel. Providing the underfloor module means that the rescue cage can be separated from the underfloor module and the underfloor module, being of smaller dimensions than the rescue cage, can be left on the ladder end during the journey to the deployment site. The detached rescue cage can be transported on the emergency vehicle separately from the ladder set. This arrangement also offers the option of being able to attach rescue cages of different designs respectively to the ladder set by means of the underfloor module.

DE 20 2006 019 106 U1 discloses a rescue cage for accommodating a stretcher having a coupling device for rescuing persons from greater heights and depths. This rescue cage also comprises a cage base as well as a cage barrier fixedly connected to the cage base and comprising a number of uprights extending up from the cage base. The individual uprights are connected to one another by cross-members. At the end remote from the cage base, the uprights are connected to a handrail. In the region of the cage front end, the cage barrier has two pivoting doors which, when in the pivoted open position, provide access to the rescue cage and enable a platform in the form of a stretcher holding device to be accommodated. A receiving bush is also disposed in the cage base, in which a latch bolt attached to the bottom face of the platform can be inserted, enabling the platform to be mounted in a pivoting arrangement. In addition, a pivotable pedestal connected to the cage base is provided in the front door region, which forms a part of the cage barrier in the folded-up position. In the folded-down position, the pedestal serves as an additional support for the platform supported on the cage base and projecting out beyond the cage front end. The pedestal can also be used to make it easier to accommodate a wheelchair in the rescue cage when the platform is not needed. Due to the fixed connection of the cage barrier to the cage base, only the region of the cage barrier in which the pivoting doors are disposed can be opened in order to accommodate the platform and the stretcher to be received thereon.

In the case of hoisting rescue vehicles known to date, especially those having a turntable ladder with the rescue cage mounted on it, at least one so-called multi-function column is fixedly mounted on the outer peripheral region of the rescue cage for accommodating and retaining a stretcher support. This multi-function column extends out from the cage base into the region of the handrail or an upper guardrail. On the end region remote from the cage base, the at least one multi-function column has a receiving device for a connecting element that can be connected to it. The connecting element may be provided on the stretcher support or on another attachment part such as a water cannon, a foam nozzle, a floodlight or such like. Since the height of the multi-function column is selected so that it extends into the region of the handrail, the stretcher support is disposed above the handrail and can therefore be pivoted or rotated relative to the rescue cage about a large angular range as required, depending on the design of the mounting point. Accordingly, the at least one multi-function column can be disposed in the region of the left-hand and/or right-hand cage side. Based on another design, two multifunction columns are mounted in a middle portion of the cage front end, fixedly secured to the cage base. The disadvantage of mounting the stretcher support at the side of the rescue cage is the torsional moment exerted on the ladder set. It also makes it difficult for the emergency worker or rescue personnel to provide direct assistance in particular to the patient on the stretcher mounted on the stretcher support due to the position high above the cage base.

The underlying objective of this invention is to propose a rescue cage for a hoisting rescue vehicle, in particular having a turntable ladder, as well as a hoisting rescue vehicle equipped with a rescue cage of said type, whereby maneuvering and providing assistance to the patient are made easier so that the patient can be better attended to during the rescue operation. Furthermore, however, irrespective of the above, it should also be easier to accommodate at least one person seated on a wheelchair or a stretcher chair in this rescue cage and less effort should be required on the part of the rescue worker. More generally speaking, it should be possible to modify the rescue cage to suit a range of different deployment situations.

This objective is achieved by the invention due to the fact that at least one first receiving device is provided or disposed on the cage base in the region of the at least one support element disposed in the outer peripheral region of the cage base and the at least one first support element is provided in the form of a sleeve. The at least one support element has a first connecting element on its end facing the cage base, which first connecting element can be connected to the first receiving device in such a way as to be detachable as required. The first connecting element is provided in the form of a plug-in pin and the plug-in pin is connected to an end of the support element facing the cage base. When the support element is removed from the first receiving device, at least one accessory connecting element provided or disposed on an accessory can be connected to the first receiving device in such a way as to be detachable as required.

The advantages obtained as a result reside in the fact that even in the case of turntable ladders having a rescue cage, the cage base, which can be entered via otherwise only narrow passage openings or access openings, can still be kept open in the region of its cage front end to the degree that a person holding unit can be fitted close to the floor as and when required. Due to the fact that the first receiving device is provided in the form of a sleeve, the first connecting element together with the support element or alternatively also a second connecting element of an accessory or a person holding unit can be accommodated whilst requiring the smallest amount of space. This offers a simple combination of options to cater for different deployment situations. This means that, having removed the at least one support element, the receiving device in the floor region of the rescue cage is now free and can be used so that an accessory or a functional element having a connecting element complementing the first receiving device can be connected and thus retained on the rescue cage. This also imparts greater flexibility to the rescue cage because once the support element has been removed, the receiving device that has now become free can be used to insert and hold a range of different aids.

Due to the fact that it is now possible to remove, slide away or fold away parts of the cage barrier, attending to the person to be rescued and subsequent maneuvering of the stretcher are made much easier for the rescue personnel. This offers a reversible option for converting a closed barrier structure of the rescue cage into a cage base that is freely accessible in the region of its cage barrier, in particular its front end, and restoring it to a fully closed structure again. Compared with the usual standard arrangement of the person holding unit in the form of a stretcher device above the handrail, in which direct intensive treatment such as resuscitation cannot be administered at all or can be but only with great difficulty whilst being transported in the rescue cage, this is now made much easier due to the positioning in the rescue cage close to the floor. If the person to be rescued or saved is disposed close to the floor of the cage base, life-saving emergency procedures can be started as soon as the stretcher has been fitted on the person holding unit and continued until the transfer is made to other rescue personnel on the ground. Furthermore, the subsequent removal of the stretcher from the stretcher holding device to the ground on which the hoisting rescue vehicle is standing is made easier because the height from which it has to be removed to ground level can be reduced. If, on the other hand, a wheelchair or stretcher chair and a person are being accommodated in the rescue cage for rescue purposes, unloading close to the ground is also simple. Opening can take place as and when required but during normal deployment for firefighting or other rescue operations, the cage barrier prevents a person or persons in the rescue cage from falling.

It is also of advantage if a first locking element is disposed or provided on the at least one support element, in particular on its first connecting element, or on the at least one accessory connecting element of the accessory, and a second locking element is provided on the at least one first receiving device, which locking elements engage with one another when the first connecting element and first receiving device or the accessory connecting element and first receiving device are in the mutually connected position and thus form a locking mechanism. This prevents inadvertent removal of the support element, especially if it is an integral part of the cage barrier. Providing the locking elements and the resultant locking mechanism means that a secure fixing means can be provided except when the locking mechanism is intentionally released. This significantly increases safety for the person in the rescue cage. It also provides a multiple locking system or multiple fixing system. Furthermore, a range of different accessories, in particular person holding units, can be held locked to the rescue cage by means of the at least one accessory connecting element provided on it. This also prevents the accessories from being unintentionally detached from the rescue cage.

Another possible embodiment has features whereby the at least one accessory connecting element of the accessory can be connected to the first receiving device so as to be detachable when necessary with at least one spacer element connected in between. By providing the additional spacer element, the distance of the accessory, in particular the person holding unit, from the cage base defining the support surface can be varied. This enables more universal deployment of the rescue cage with the accessory attached to it.

Based on another embodiment, several, in particular two, mutually spaced apart first receiving devices are provided, in particular in a middle section of the cage front end and on the cage base as viewed in its longitudinal extension. This offers the possibility of placing the support element or elements in different positions on the rescue cage. Furthermore, however, several support elements can be secured next to one another in the region of the cage periphery such that they can be detached as and when necessary. This provides more options for varying the opening of the cage barrier of the rescue cage. Furthermore, however, this also enables the accessories to be placed on the rescue cage in different positions from one another, in particular the person holding unit.

Another embodiment is characterized by the fact that one of the support elements can be attached respectively to each of the first receiving devices and the support elements can be connected to one another, in particular in the region of their ends remote from the cage base, by means of at least one connecting element extending between them. When the support elements are mounted, in particular in the region of the cage front end, this forms the cage barrier and provides a safe closure. Furthermore, the gap formed between the two support elements can also be used as an access opening which can be closed off as required by providing a folding ladder.

Based on another preferred embodiment, the at least one support element has an upper receiving device in its end region remote from the cage base and the accessory connecting element of the accessory can be connected to the upper receiving device in such a way that it can be detached as required. Providing the upper receiving device means that when a support element is disposed on the rescue cage, an attachment part can be retained on it and detached as and when necessary. Furthermore, this also offers the possibility of enabling the person holding unit, in particular the stretcher holding device, to be retained in a position at a distance from the cage base.

It is also of advantage if the cage barrier has at least one closable access opening, which access opening is disposed in particular in the region of the cage front end. This makes it easier for the rescue or operating personnel to get into or out of the rescue cage. Providing the closable access opening makes it easy to climb into the rescue cage or out of it even in the presence of the removable support elements. If the access opening is provided in the region of the cage front end, the support element or elements can be removed to make the width of the opening of the cage front end even bigger. Accordingly, with a few manual operations, the rescue cage can be rapidly modified to enable a range of different accessories to be provided and attached to it, in particular the person holding unit.

Another possible embodiment has features whereby the at least one closable access opening extends from the at least one support element into the region of the left-hand and/or right-hand cage side. This offers the option of making the width of the opening of the rescue cage as big as it can possibly be in the region of its cage front end. Since the access openings are usually closed by means of pivoting or sliding doors, the cage front end can be opened rapidly and without the need for tools when modifying it to accommodate the person holding unit.

Furthermore, almost the entire width or length of the cage front end can be easily opened, making a large amount of space available on the rescue cage. This makes loading and unloading easy in a position close to the ground.

Another embodiment is characterized by the fact that the rescue cage and/or the accessory is provided with at least one actuator, in particular a cable winch, a chain block, a pulley block, a linear drive, a spindle drive, a rack and pinion drive, a pressure-operated drive or a deflection roller. This makes it much easier for the rescue personnel to move a stretcher or a wheelchair or stretcher chair onto the person holding unit. The support afforded by the actuator also makes it possible to move heavier persons, for example by means of ramps or other aids, more easily into the region of the rescue cage where the person holding unit is disposed.

It is also of advantage if the actuator is connected to the accessory by means of a coupling device in such a way as to be detachable as required. This results in even greater flexibility during rescue operations and enables modifications to be made rapidly in changing situations.

A preferred embodiment is one where the accessory is selected from the group comprising floodlights, high-pressure blowers, water cannon or holders for the latter, ramps, person holding units such as a stretcher holding device, stretcher chair holding device or wheelchair holding device. The different types of accessories that can be accommodated make the rescue cage well suited to universal deployment. A change or modification can be made rapidly from one accessory to another accessory enabling a rapid response to changing deployment conditions.

Another possible embodiment has features whereby the ramp is disposed on the accessory provided in the form of a person holding unit and can be retained thereon in a detachable manner in particular. This makes the transfer or moving of the stretcher, wheelchair or stretcher chair onto the person holding unit or rescue cage much easier. Furthermore, it also offers the option of providing an additional platform in the form of an extension of the respective person holding unit, thereby enabling larger distances to be bridged between building structures and the rescue cage. The ramp in this embodiment can be considered a complementary part to the person holding unit. Alternatively, it is at least one accessory including a first accessory being a person holding unit and a second accessory being the ramp.

Another embodiment is distinctive due to the fact that the ramp is of a pivotable design. This offers an additional safety feature to prevent undesired shifting or falling in the region of the rescue cage once the respective transport or rescue means has been received on the person holding unit and during subsequent transport.

Another preferred embodiment is one where the ramp can be locked in at least one of its pivoted positions by means of a locking mechanism. This offers even greater safety in preventing undesired movement.

The objective is also achieved independently by the features defined in accordance with another aspect of the invention. The advantages gained by the combination of features according to this aspect are that even in the case of turntable ladders having a rescue cage, the cage base, which can be entered via otherwise only narrow passage openings or access openings, can still be kept open in the region of its cage front end to the degree that an accessory, in particular a person holding unit, can be fitted close to the floor as required. Due to the fact that it is now possible for parts of the cage barrier to be removed, moved or folded away, attending to the person to be rescued and subsequent maneuvering of the stretcher are made significantly easier for the rescue personnel. Furthermore, because the person holding unit is disposed more or less centrally relative to the longitudinal extension of the ladder set of the turntable ladder, fewer forces are transmitted eccentrically to the turntable ladder. This reduces or even totally prevents any twisting of individual ladders of the ladder set of the turntable ladder.

Compared with the usual standard arrangement of the person holding unit, in particular, a stretcher device, above the handrail, in which direct intensive treatment such as resuscitation cannot be administered at all or can be but only with great difficulty whilst being transported in the rescue cage, this is now made much easier due to the positioning in the rescue cage close to the floor. Furthermore, the subsequent removal of the stretcher from the stretcher holding device to the ground on which the hoisting rescue vehicle is standing is made easier because the height from which it has to be removed to ground level can be reduced. If the person to be rescued is disposed close to the floor of the cage base, life-saving emergency procedures can be started as soon as the stretcher has been fitted on the person holding unit and continued until the transfer is made to other rescue personnel on the ground. Opening can take place as and when required but during normal deployment for firefighting or other emergency and rescue operations, the cage barrier prevents a person or persons in the rescue cage from falling.

Furthermore, an actuator may be provided on the person holding unit, in particular a stretcher holding device, stretcher chair holding device or wheelchair holding device, in particular a cable winch, a chain block, a pulley block, a linear drive, a spindle drive, a rack and pinion drive, a pressure-operated drive. This makes it much easier for the rescue personnel to move the stretcher or a wheelchair or a stretcher chair onto the person holding unit. The support afforded by the actuator also makes it possible to move heavier persons, for example by means of ramps or other aids, more easily into the region of the rescue cage where the person holding unit is disposed for example.

Another possible embodiment has features whereby the actuator is connected to the person holding unit, in particular a base frame, by means of a coupling device so as to be detachable as required. Accordingly, an accessory can easily be changed when required and the actuator does not have to be coupled and retained until an additional traction force is needed.

It is also of advantage if a ramp is provided on the person holding unit which is detachably retained thereon in particular. Accordingly, an additional aid for the loading operation and unloading operation is rapidly provided on site for deployment. More universal deployment of the person holding unit is therefore achieved.

Finally, based on another embodiment, the ramp is of a pivotable design and in particular can be locked in at least one of its pivoted positions by means of a locking mechanism. This enables the loading operation or unloading operation to be more easily adjusted to different height levels. At the same time, however, this also offers greater protection or safety for the person being accommodated depending on the relevant position.

To provide a clearer understanding, the invention will be described in more detail with reference to the appended drawings.

Figure 2:
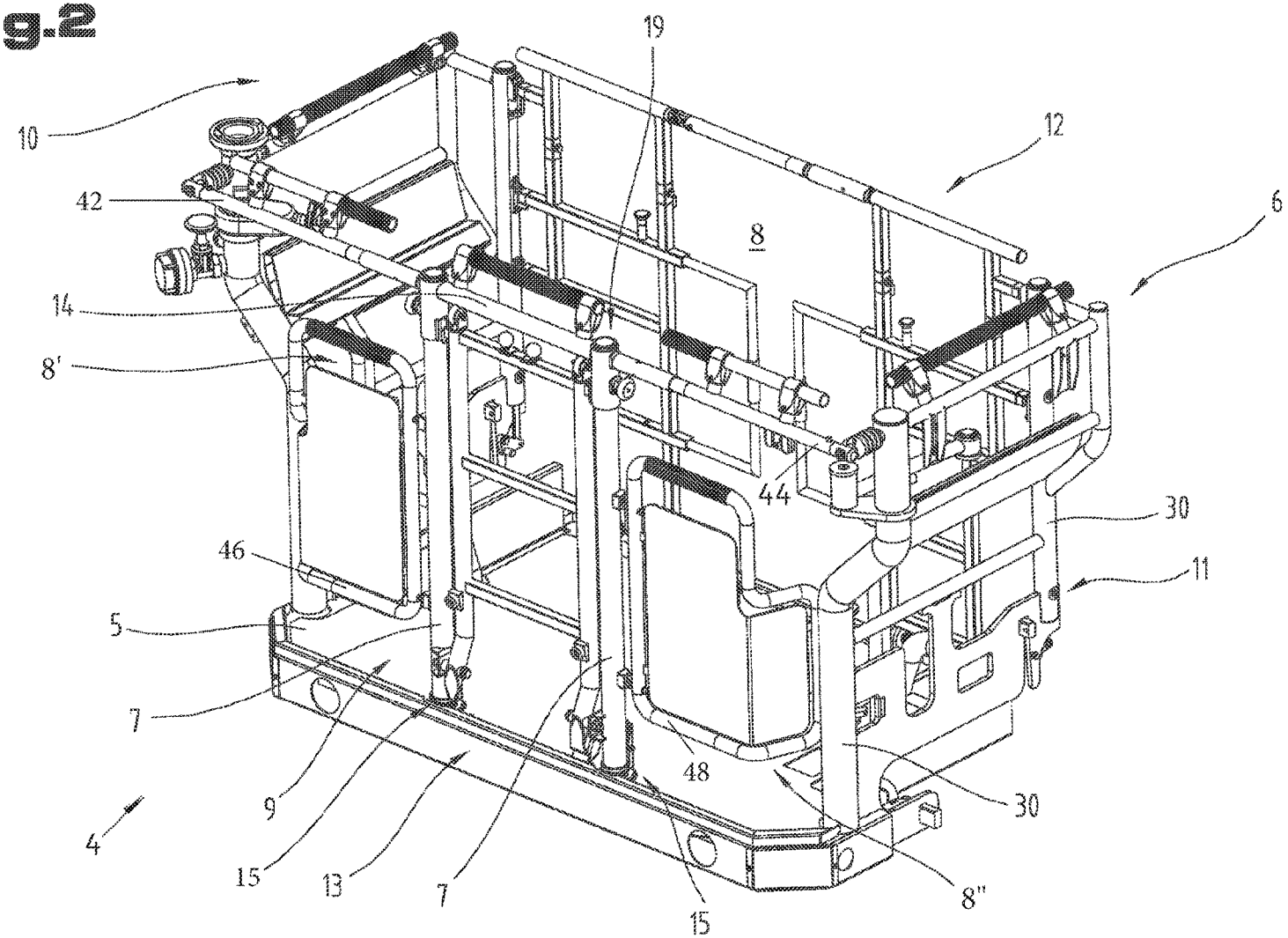
Figure 3:
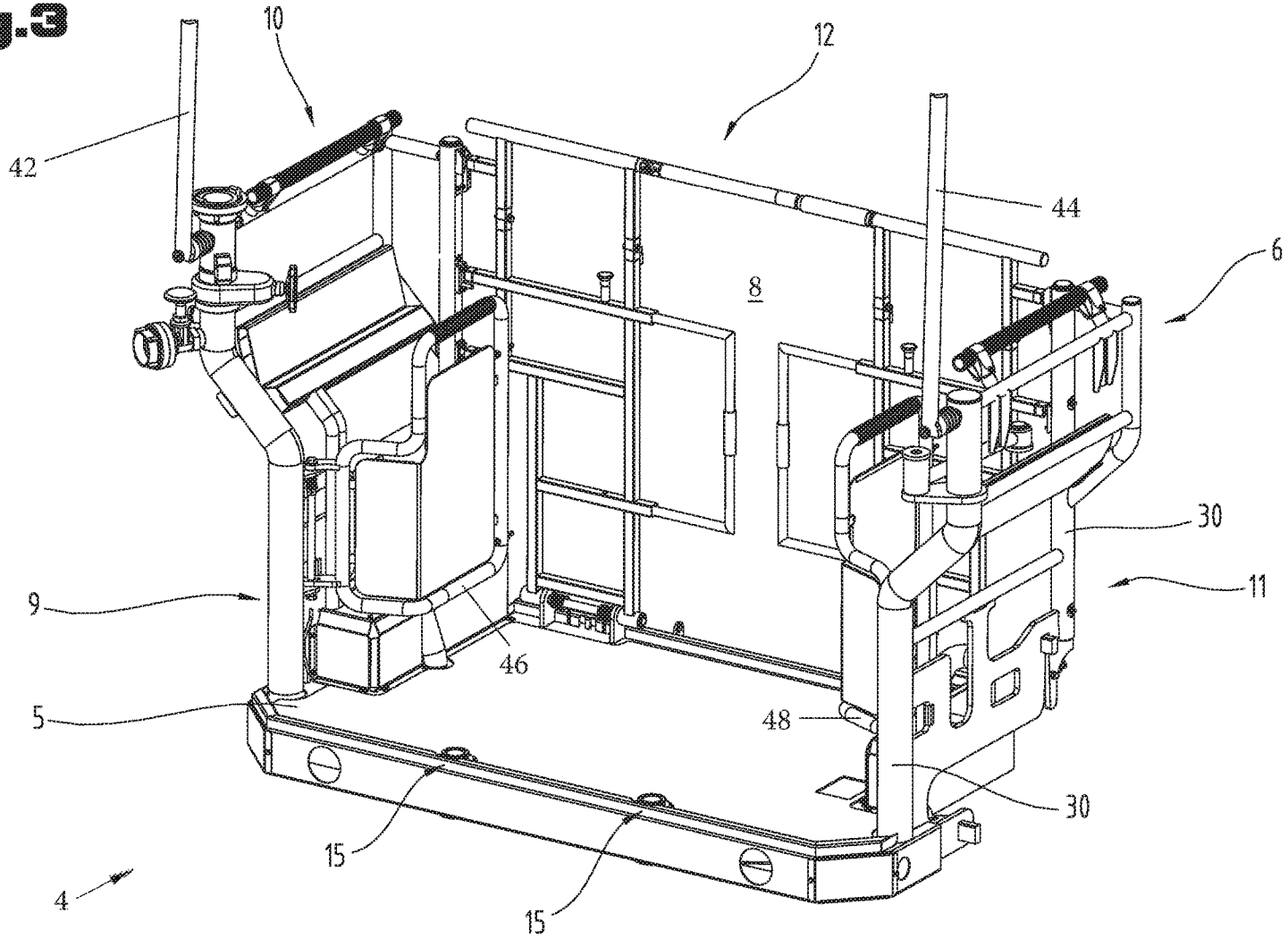
Figure 4:
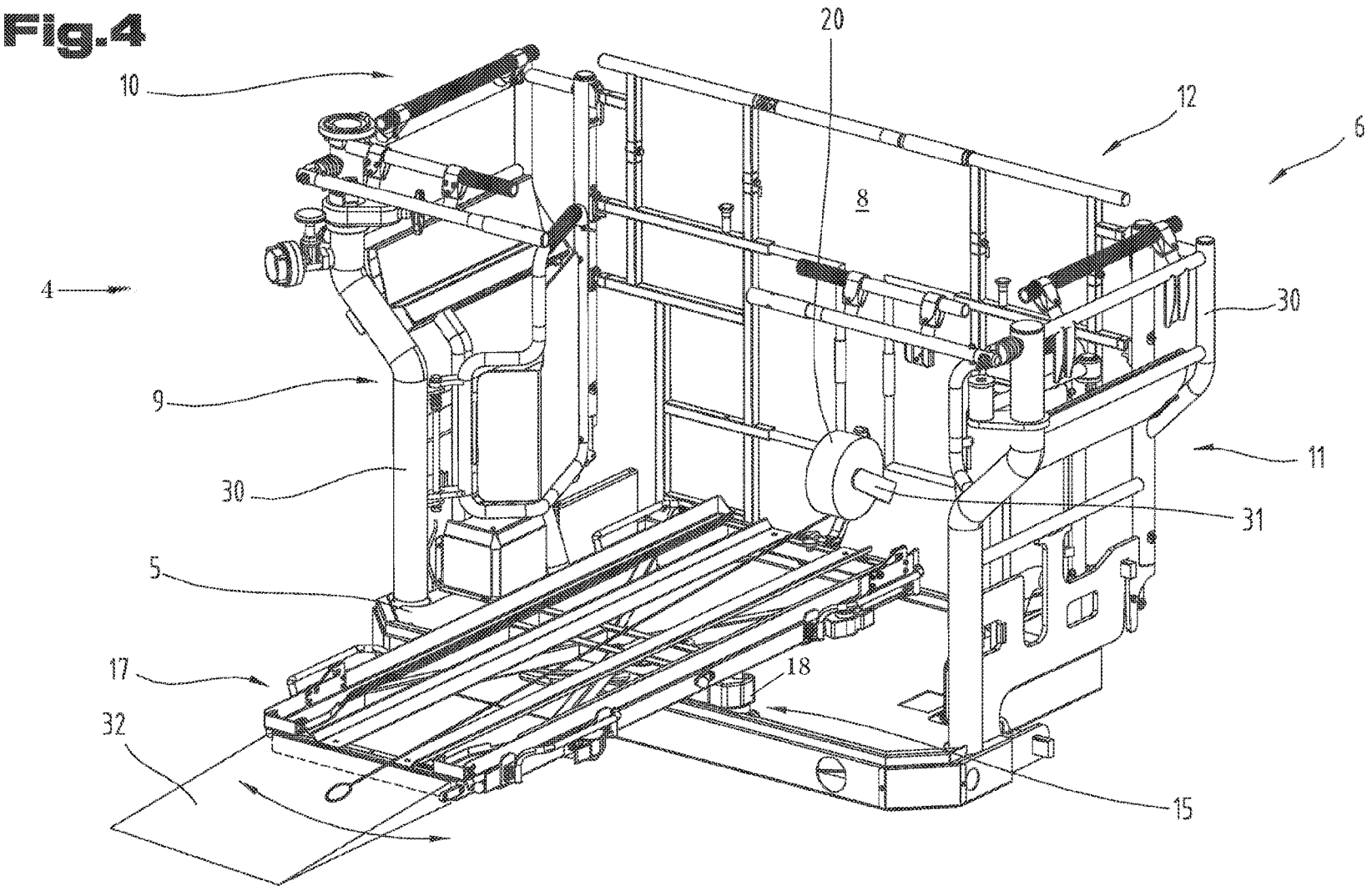
Figure 5:
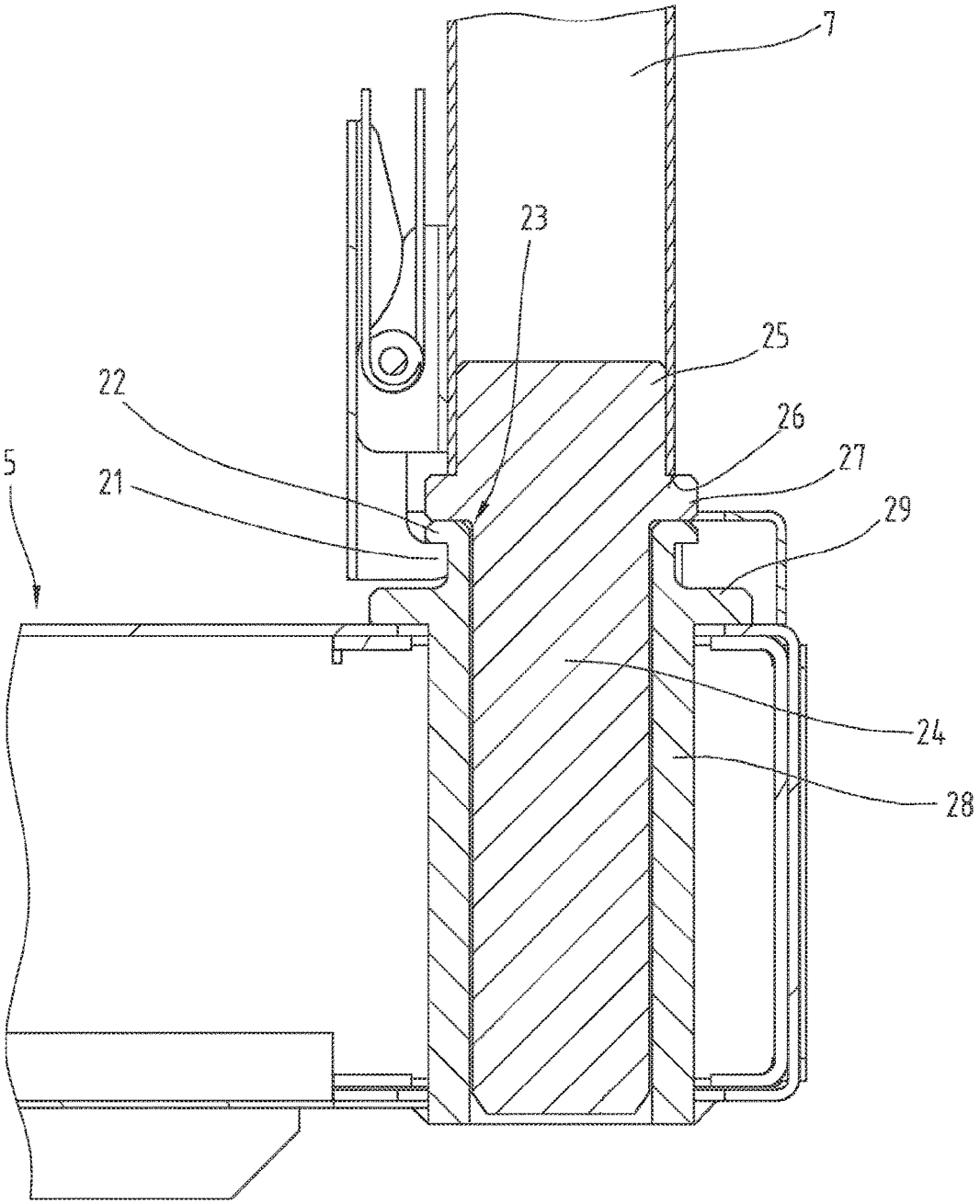
Figure 6:
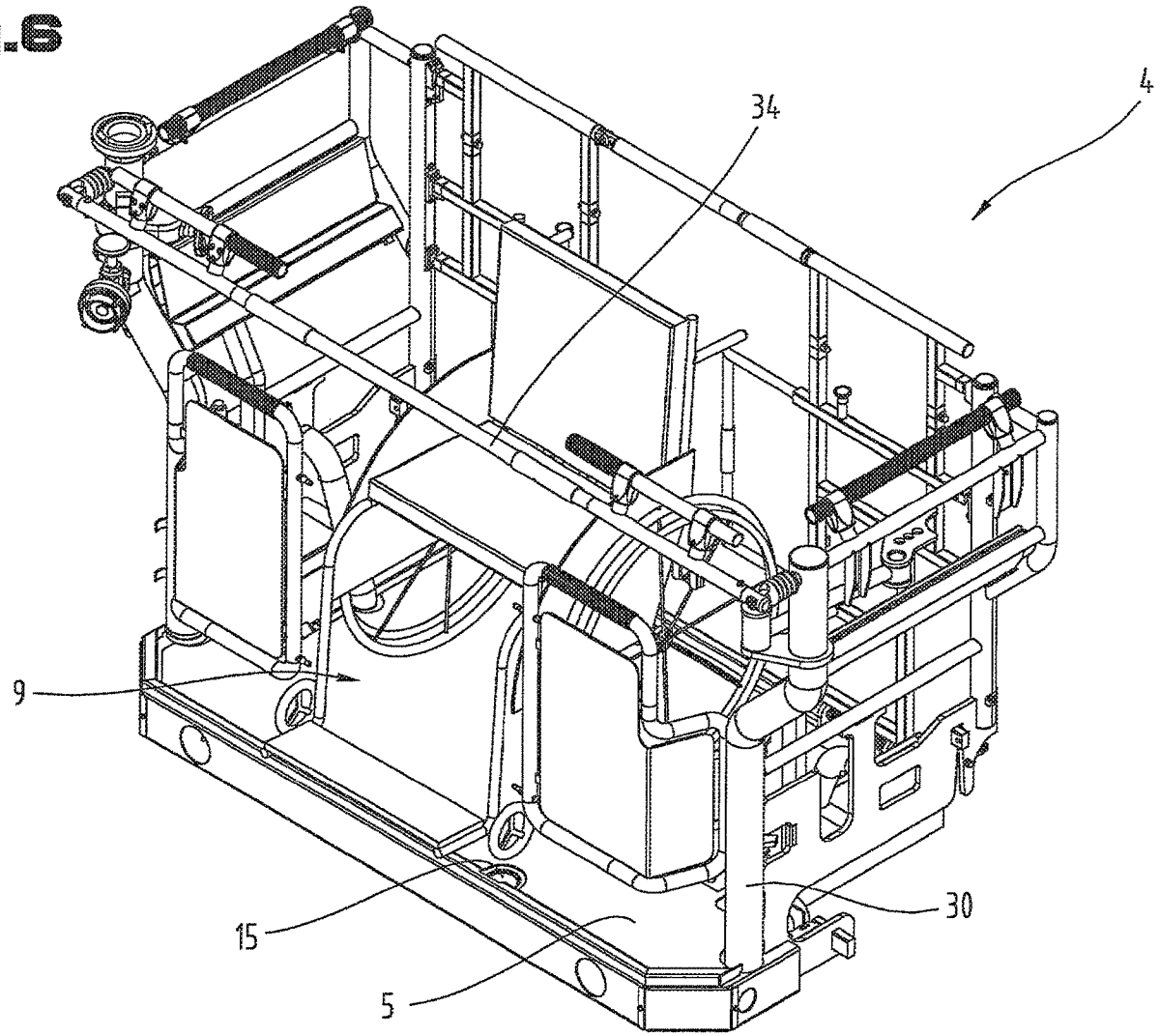
Figure 7:
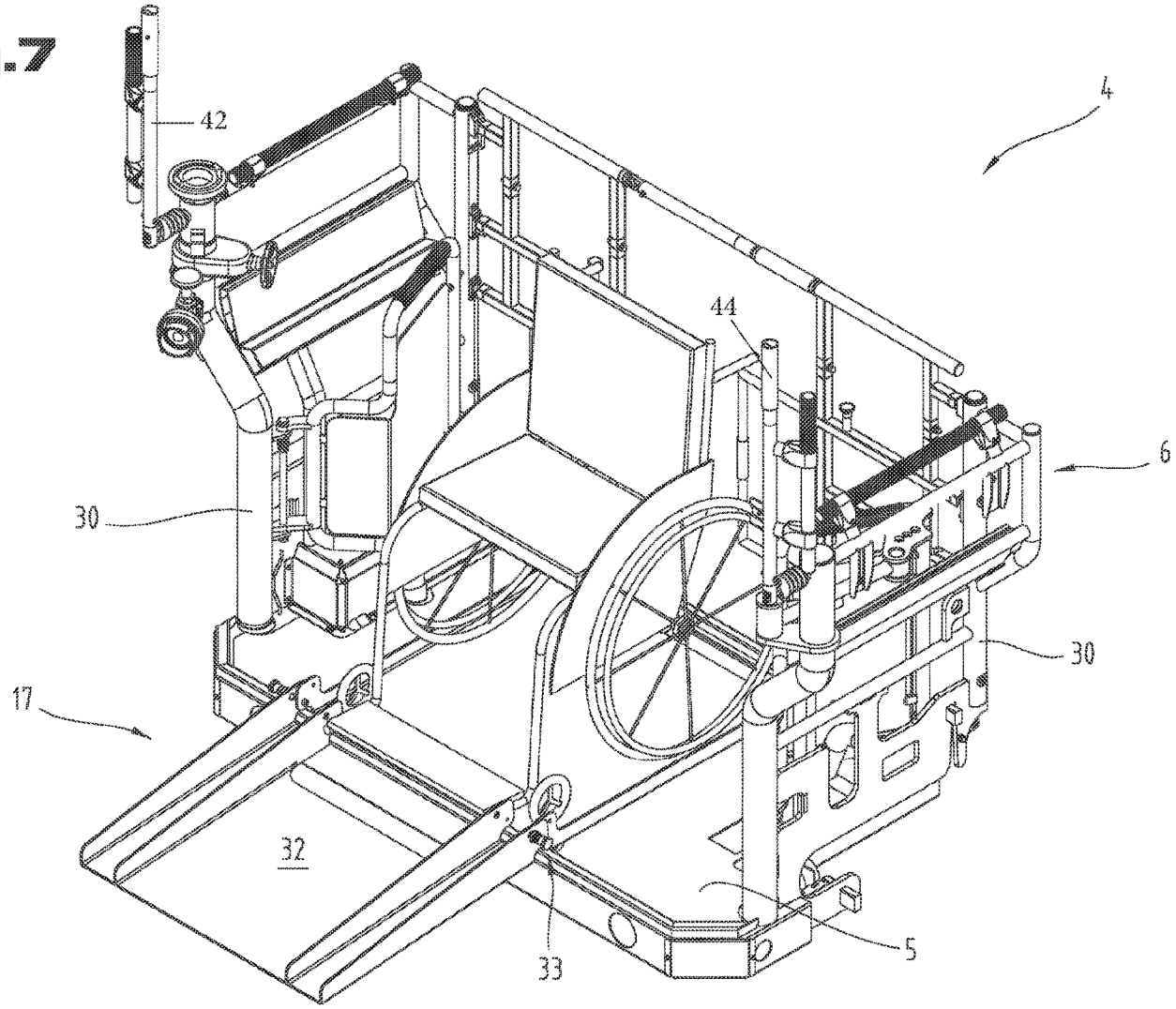
Figure 8:
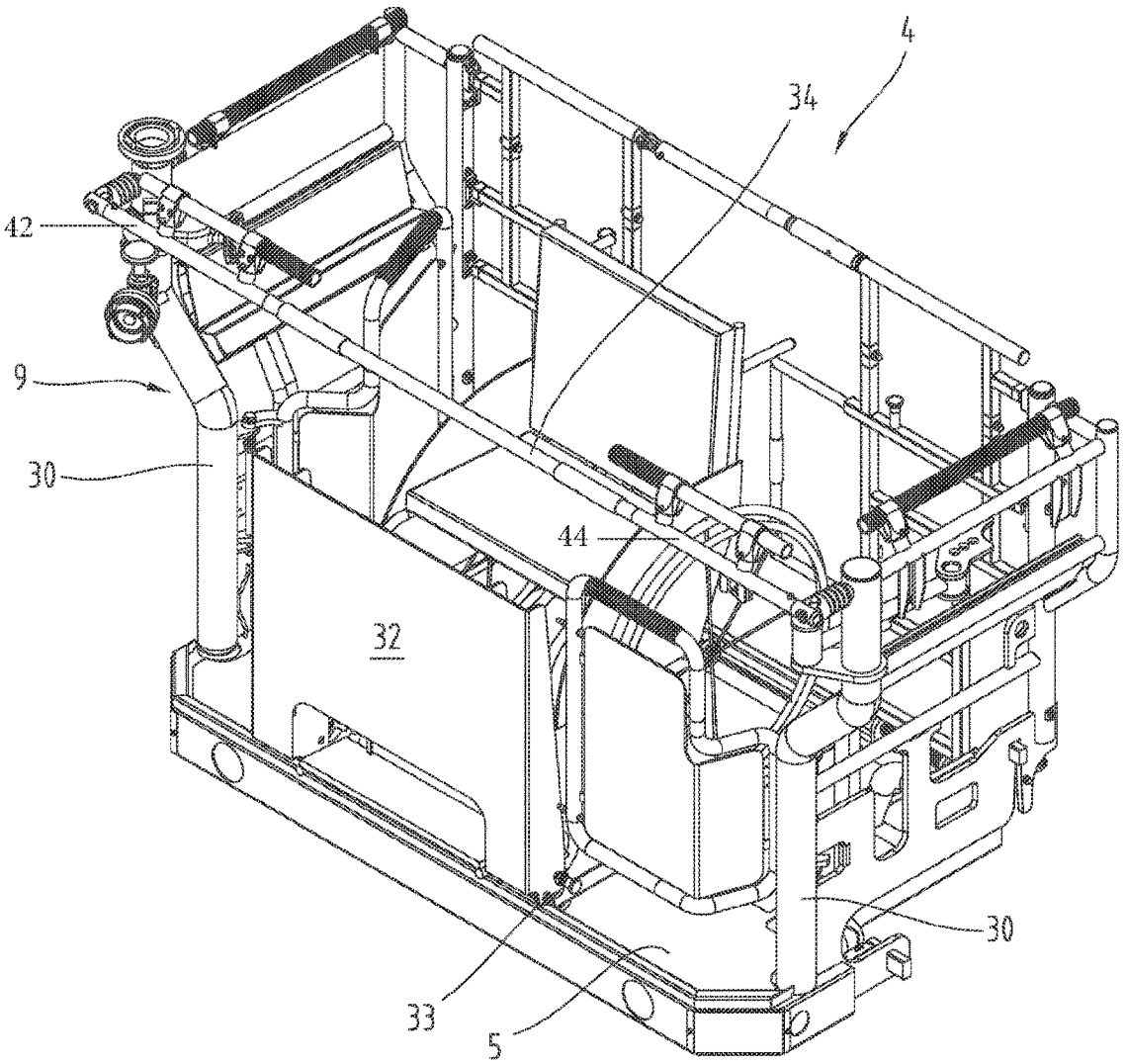
Figure 9:
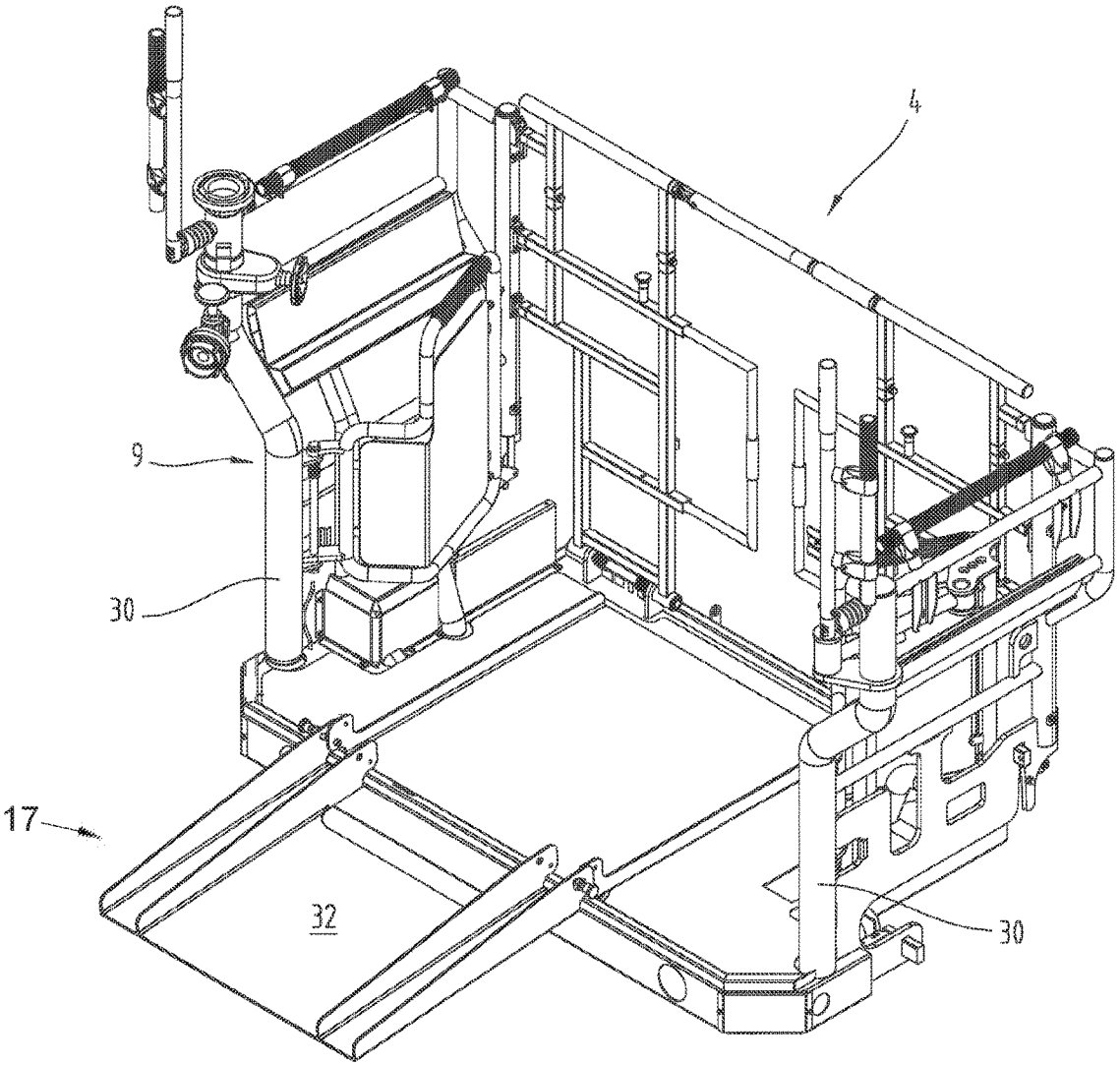

These are highly simplified, schematic diagrams illustrating the following:

FIG. 1 a side view of a hoisting rescue vehicle with a turntable ladder and a rescue cage;

FIG. 2 a perspective view of the rescue cage illustrated in FIG. 1 on its own, with a cage base, a cage barrier surrounding the latter and column-type support elements;

FIG. 3 a perspective view of the rescue cage illustrated in FIG. 2, but with the cage front end open;

FIG. 4 a perspective view of the rescue cage illustrated in FIGS. 2 and 3 with the cage front end open and an accessory in the form of a stretcher support serving as a person holding unit;

FIG. 5 a view in axial section illustrating a detail of one possible detachable retaining means of the support element on the cage base;

FIG. 6 a perspective view of the rescue cage illustrated in FIGS. 2 and 3 with the cage barrier partially closed and a wheelchair accommodated in the rescue cage;

FIG. 7 a perspective view illustrating another rescue cage with the cage barrier open and an accessory provided as a wheelchair holding device serving as a person holding unit, disposed in the floor region, and with a wheelchair retained on it:

FIG. 8 a perspective view of the rescue cage illustrated in FIG. 7 with the cage barrier closed;

FIG. 9 a perspective view of the rescue cage illustrated in FIGS. 7 and 8, without a wheelchair and with the ramp of the accessory folded down.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. The expression "in particular" as used below should be understood as meaning one possible, more special embodiment or more specifically defined object, although not necessarily a preferred embodiment of that object.

FIG. 1 is a simplified illustration of a hoisting rescue vehicle 1 which may be used by a firefighting service or other emergency and/or rescue services. The hoisting rescue vehicle 1 might also be used solely for extinguishing functions but nevertheless also enables operations to rescue people or animals to be carried out or technical aid to be provided at different heights or depths. Accordingly, the hoisting rescue vehicle 1 based on this example of an embodiment has a chassis 2 illustrated in simplified form, a turntable ladder 3 disposed thereon with a ladder set and a rescue cage 4 retained on the ladder set of the turntable ladder 3. The turntable ladder 3 comprises a rotating or pivoting system by means of which the ladder set can be moved accordingly.

However, the hoisting rescue vehicle 1 could also have a telescopic ladder or articulated mast instead of the turntable ladder. The rescue cage 4 is usually disposed at an end of the ladder set of the turntable ladder 3 remote from the chassis 2 and rotating or pivoting system 3 and can be pivoted and moved accordingly for moving to and from the deployment site and when being deployed for its intended purpose.

Hereafter, the rescue cage 4 alone is illustrated and described although no further details will be given as to how it is retained and mounted on the turntable ladder 3. In describing the design of the rescue cage 4, reference will also be made to the relevant standards and the corresponding terminology will be used as far as possible.

FIGS. 2 to 9 illustrate different views and different examples of embodiments of the rescue cage 4, which comprises a cage base 5, a cage barrier 6 and at least one in particular column-type support element 7. The support element 7 might also be referred to as a multi-function column. The cage base 5 may also be referred to as a platform or working platform. The purpose of the cage barrier 6 is to prevent a person or persons working on the cage base 5 from falling and protect them from the effects of heat and/or radiation. The cage barrier 6 may therefore also be described as a guard which can be made up of different individual components. In this instance, the support element or elements 7 are designed so that they can be removed or detached from the cage base 5 as and when necessary.

The cage barrier 6 may comprise, for example, a handrail, baseboards in the region of the cage base 5, a top guardrail and/or several additional uprights 30 or columns. The additional uprights 30 in this example of an embodiment are disposed in the side region of the rescue cage 4. The upright or uprights 30 are usually permanently connected to the rescue cage 4, in particular its cage base 5. In this respect, it should be noted that the disposition of the support element or elements 7 as well as the upright or uprights 30 illustrated here is just an example and any other layout is also possible. It would also be possible for the cage barrier 6 to be made up of only support elements 7 that can be removed or of individual parapet units formed by the support elements 7. For this embodiment in which the cage barrier 6 is made up entirely of support elements 7, the entire cage barrier 6 can be removed from the cage base 5.

To provide access inside the cage barrier 6 making it possible to get onto the cage base 5, one or more closable access openings 8, 8', 8" may be provided or arranged in the region of the cage barrier 6. The access opening 8, 8', 8" may be designed so that it can be closed off by means of a trapdoor, a folding ladder, a sliding door, a folding door 46, 48 or such like, for example. The handrail may additionally be disposed above the access opening 8, 8', 8". The at least one closable access opening 8', 8" in this example of an embodiment is disposed in the region of the cage front end 9, although it may also be disposed in the corner region and/or on another cage side of the cage barrier 6.

The cage barrier 6 in this example of an embodiment is disposed in the region of a cage front end 9, in the region of a left-hand and/or right-hand cage side 10, 11 and optionally also in the region of a cage rear end 12. A front barrier section of the cage barrier 12 can include at least three front handrail sections including a left handrail section 42, a middle handrail section 14, and a right handrail section 44.

The rescue cage 4, in particular its cage barrier 6, also comprises at least one but preferably several of the column-type support elements 7. The column-type support element or elements 7 extend up from the cage base 5 and are disposed on it in the outer peripheral region of the cage base 5. In this particular example of an embodiment, two support elements 7 are disposed in the region of the cage front end 9 in its middle section 13, and in order to impart additional strength and form a frame element, especially in the region of their ends remote from the cage base 5, they may be connected to one another by means of at least one middle handrail section 14 extending between them—in this particular example of an embodiment by a bar. However, the middle handrail section 14 may be provided in the form of some other component, for example a sheet metal part, a flat bar or similar. This being the case, it is possible to provide an integral parapet unit (shown in FIG. 2) comprising at least two support elements 7 and one or more cross elements extending between the two support elements 7 which can be removed from the cage base 5 as a hole.

The support element or elements 7 has/have a height or length such that they extend from the cage base 5 to approximately the region of the handrail. The latter is disposed at least 1.1 m above the standing surface defined by the cage base 5. This height is the standard currently in force and any modification must conform to this stipulation.

As described above, a folding ladder may be provided between the two in particular column-type support elements 7 which closes off the gap constituting the access opening when in the folded-in position. Furthermore, at least one other closable access opening 8', 8" may be provided, extending from the at least one support element 7 into the region of the left-hand cage side 10 and/or the right-hand cage side 11. The at least one closable access opening 8', 8" is preferably provided on both sides of the at least one support element 7 respectively. However, there may be multiple access openings 8', 8" namely in the corner region and/or at least one of the other cage sides 10 to 12.

In this particular example of an embodiment, the other access openings 8 disposed on either side of the two column-type support elements 7 can each be closed by means of an inwardly opening folding door or pivoting door.

In order to provide virtually free access to the rescue cage 4 from its cage front end 9 and make the cage barrier 6 open at the front starting from the cage base 5, at least one first receiving device 15 is provided on the cage base 5 in the region of the at least one support element 7, preferably two support elements 7.

The at least one column-type support element 7 has a first connecting element 16 on its end facing the cage base 5. The first connecting element 16 can be connected to the first receiving device 15 such that it can be released as and when necessary. Accordingly, the, or in this particular example of an embodiment the two support elements 7 in the region of the cage front end 9 can be removed from the rescue cage 4 as and when required. This removal may be by taking them away or by a sliding or pivoting movement. If two or more such support elements 7 are provided, a separate first receiving device 15 is also provided or disposed in the region of the cage base 5 for each one of the support elements 7.

Furthermore, the at least one other access opening 8', 8" on either side of the column-type support elements 7 closed by the folding door 46, 48 or pivoting door can also be opened by a pivoting movement. FIG. 3 shows the folding doors 46, 48 in the open position after folding or pivoting. By opening the access openings 8', 8" on either side, almost the entire width of the cage base 5 can be opened up in the region of its cage front end 9. This is best illustrated in FIG. 3. FIG. 3 shows a left handrail section 42 having been pivoted up and out of the one access opening 8'. FIG. 3 shows a right handrail section 44 having been pivoted up and out of the access opening 8" on the other side. In the region of the cage front end 9, the two first receiving devices 15 can still be seen in the region of the cage base 5.

Now that it is possible to open up the cage barrier 6 around a certain part of its extension by removing at least individual ones of the support elements 7, an accessory 17 having a complementary part can be retained in the at least one first receiving device 15 that has now been freed up. The accessory 17 may be selected from the group comprising floodlights, high-pressure blowers, water cannon or holders therefor, ramps, person holding units such as a stretcher holding device, stretcher chair holding device or wheelchair holding device.

As may be seen from FIG. 4, once the cage front end 9 has been opened up, the accessory 17, for example the person holding unit in this instance, can be fitted in the vicinity of the floor in the rescue cage 4 and retained. The person holding unit in this example of an embodiment is a stretcher holding device and the description below relates to this particular embodiment.

At least one accessory connecting element 18 is provided or disposed on the person holding unit. In order to retain or secure the person holding unit on the rescue cage 4, the accessory connecting element 18 can be connected to the first receiving device 15 so as to be detachable as and when necessary. The person holding unit may also have a pivot bearing so that the relative angular position of the person holding unit can be adjusted within certain limits relative to the longitudinal orientation of the ladder set of the turntable ladder 3. This is done by the operator or rescue worker during the process of fitting the stretcher with the patient to be transported. A certain amount of adjustment can be made depending on the position of the rescue cage 4 relative to the direction in which the stretcher will be transferred.

In addition, the column-type support element 7 may have an upper receiving device 19 in the end region remote from the cage base 5—see FIG. 2. Accordingly, when the support element 7 is fitted on the cage base 5 in the first receiving device 15, another accessory 17, not illustrated, or another attachment part can also be attached, as required, in the region of the height of the handrail, e.g. a water cannon, an extinguisher nozzle, a floodlight, a cable reel, a hose reel or similar, in particular such that it can be detached when necessary. This also offers the option of connecting the person holding unit by its at least one accessory connecting element 18 to the upper receiving device 19, likewise so that it can be detached when necessary.

In order to make it easier to push the stretcher together with the patient onto the person holding unit, an actuator 20 may be provided on the rescue cage 4, in the region of the cage rear end 12 and/or directly on the person holding unit. The actuator 20 may be provided in the form of a winch, a chain block, a pulley block, a linear drive, a spindle drive, a rack and pinion drive, a pressure-operated drive or a deflection roller or such like. The pressure-operated drive may be a hydraulic or pneumatic cylinder, for example. However, the actuator 20 may also be connected to a drive unit in a driving relationship to apply the necessary force. The combination of the person holding unit with the actuator 20 may optionally be construed as an independent invention in its own right. If the actuator exerts a traction force, it may also be described as a traction drive.

In order to retain or secure the actuator 20 on the rescue cage 4, a column-type support element 7 or an upright 30 could also be provided in the region of the cage rear end 12, for example, and the actuator 20 can then be connected to an upper receiving device 19 disposed or arranged at the top end region of the support element 7 or upright 30 so that it can be detached as necessary. To this end, for this embodiment not shown the actuator 20 would also have to be equipped with at least one connecting element which can then be connected to the upper receiving device 19 so as to be detachable as necessary.

However, the actuator 20 could also be connected to a first receiving device 15 provided especially for it in the floor area of the rescue cage 4. In addition, however, the actuator 20 could be connected to the accessory 17 by means of a coupling device 31 that can be released as necessary and/or to the rescue cage 4. The actuator 20 is used to move the stretcher or carrier, wheelchair or stretcher chair together with a person on it more easily and with less force onto the person holding unit, in particular stretcher holding device, wheelchair holding device or stretcher chair holding device, in particular by pulling. The stretcher or carrier, wheelchair or stretcher chair may generally also be referred to as transport means which, by design, can be moved onto and accommodated on a person holding unit of a corresponding design. This is usually done by pulling.

It would also be possible to provide a ramp 32 on the accessory 17 if provided in the form of a person holding unit, in particular the stretcher holding device, which in particular can be releasably retained. The ramp 32 may also be of a pivotable design so that it can be set in different positions relative to the person holding unit, in particular the stretcher holding device. In addition, the ramp 32 is equipped so that it can be locked in at least one of its pivoted positions by means of a locking mechanism 33.

The person holding unit may be of various different types and its design adapted to the respective requirements. In order to accommodate a stretcher, based on different designs depending on size to cater for different sizes and/or body mass or weight of patients, it can generally be referred to as a stretcher holding device or stretcher support. Due to the possibility of being able to make the cage barrier 6 virtually open and to do so preferably in the region of the cage front end 9 as well as the fact that the person holding unit is disposed close to the floor, the medical or rescue worker is in a much better position to take care of the person being carried, in particular the patient. This is particularly the case if it is necessary to initiate lifesaving emergency procedures immediately in the rescue cage 4 as it is being moved down. To this end, the patient is preferably accommodated in the rescue cage 4 with his head and shoulder region pointing towards the cage rear end 12. The legs can therefore extend out beyond the cage front end 9 at the end remote from the cage rear end 12 but are supported by the stretcher and the person holding unit. For resuscitation purposes, the medical or rescue worker is then able to assume a much more ergonomic position requiring less force when administering cardiac massage than is the case if the person holding unit were disposed above the handrail.

As may best be seen from FIG. 5, a first locking element 21 may be provided or disposed on the at least one column-type and removable support element 7. The first locking element 21 may preferably be provided or disposed in the region of the first connecting element i.e. plugin pin 24. A second locking element 22 is provided or disposed on the at least one first receiving device 15 and the locking elements 21, 22 form a locking mechanism 23 when mutually engaged. This takes place when the first connecting element is also connected to the first receiving device 15 and/or is in the coupled position. This enables the support element or elements 7 to be secured, preventing them from being unintentionally removed from the rescue cage 4.

When at least one of the support elements 7 together with its first connecting element, e.g. plug-in pin, has been removed from the first receiving device 15, the first receiving device 15 is now free to receive another connecting element. As described above, therefore, an accessory 17 which is needed can be connected by means of its at least one accessory connecting element 18 to the first receiving device 15 specially provided for it. To prevent any unintentional release and/or to provide additional fixing, the first locking element 21 may also be provided or disposed on the at least one accessory connecting element 18. This can then likewise engage with the second locking element 22 disposed or provided on the first receiving device 15 to form the locking mechanism 23. The accessory 17 can therefore be locked or fixedly retained.

To enable the accessory 17, in particular the person holding unit in the form of a stretcher holding device, to be supported at a predefined distance above the standing surface formed by the cage base 5, it would also be possible for the at least one accessory connecting element 18 of the accessory 17 to be connected to the first receiving device 15 so as to be releasable when necessary with a spacer element connected in between, although this is not illustrated. The design of the at least one spacer element may be similar to the design of the support element 7 but of a shorter or lesser length or height or may also be of a longer design.

The support element 7 is usually tubular. The first connecting element 16 may be provided in the form of a plug-in pin 24, for example, which is connected to the end of the support element 7 facing the cage base 5. The plug-in pin 24 may extend into the tubular support element 7 by means of a centering shoulder 25. The end region of the plug-in pin 24 may be of a conically or wedge-shaped tapering design, at least in certain sections. Furthermore, an end face 26 of the support element 7 may be supported in the axial direction on what is usually a flange-type shoulder 27 of the plug-in pin 24. The shoulder 27 may serve as a supporting part for the entire support element 7 affording axial support on the first receiving device 15.

The first receiving device 15 is provided in the form of a sleeve 28 having a three-dimensional shape in its interior which approximately complements that of the plug-in pin 24. This enables the plug-in pin 24 and the support element 7 connected to it to be received in the first receiving device 15 and hence centered to a certain degree. In the axial direction, the sleeve 28 may be supported on a flange 29 provided on it or integral therewith.

Another possible embodiment of the accessory 17 in the form of a person holding unit would be a wheelchair holding device or stretcher chair holding device. This is illustrated on a simplified basis in FIGS. 6 to 9.

In this example of a rescue cage 4 in conjunction with a turntable ladder 3 in particular, it is possible, by opening up the cage barrier 6 as necessary, to accommodate a person seated on a wheelchair or stretcher chair in the rescue cage 4 more easily without the person together with the wheelchair or stretcher chair having to be lifted into the rescue cage 4 over the handrail. If then being transported in the rescue cage 4, additional retaining or safety devices will have to be provided to prevent either the stretcher together with patient or the wheelchair with the person seated on it from falling off.

In this connection, however, it should be noted that to ensure the safety of the emergency or rescue worker or several of them, at least one but preferably several retaining elements are provided, distributed around the rescue cage 4, in particular in the region of the cage barrier 6, to which the rescue worker or rescue workers can secure themselves, e.g. by means of a safety element such as a safety rope or similar, so that they do not fall off the rescue cage 4 when it is open at the front.

FIG. 6 illustrates how a wheelchair is accommodated and positioned in the rescue cage 4 on its cage base 5 for rescue purposes. In this particular example of an embodiment, the cage barrier 6 has been at least partially removed for this purpose in the region of the cage front end 9. In order to provide a certain degree of protection and prevent falling out of the rescue cage 4 nevertheless, the handrail is rendered continuous by means of an auxiliary element 34 in the region of the cage front end 9, which is bar-shaped in particular. The removable support element or elements 7 have already been removed and partial regions of the cage front end 9 can also be closed by means of door flaps or similar.

In the case of the rescue cage 4 illustrated in FIGS. 7 and 8, the ramp 32 is disposed on the rescue cage 4 in the region of the cage base 5, making it easier to push a wheelchair or stretcher chair in or out. The ramp 32 can be releasably attached to the rescue cage 4, in particular to its cage base 5. To this end, an accessory connecting element 18 provided on the ramp 32 co-operates with the first receiving device 15. Accordingly, the ramp 32 can be fitted as and when necessary and rapidly removed again as required. Furthermore, the ramp 32 may be based on a pivoting design to enable it to be adjusted to different positions relative to the cage base 5. The ramp 32 may also be of a design whereby it can be locked in at least one of its pivoted positions by means of the locking mechanism 33.

If a control device for effecting the movement of the rescue cage 4 is disposed in the rescue cage 4 itself in the region of the cage barrier 6, for example, it is possible to fit the ramp 32 eccentrically relative to the width of the rescue cage 4. However, it is also possible for the ramp 32 itself to be mounted on the cage base 5 so as to be pivotable in a plane parallel therewith. Furthermore, the viewing direction of the person accommodated in the rescue cage and seated on the wheelchair or stretcher chair can be freely selected as required. In this particular example of an embodiment, the viewing direction is from the cage rear end 12 in the direction towards the cage front end 9.

The diagram in FIG. 9 illustrates how the ramp 32 is oriented relative to the cage base 5 when in the folded down position. In this particular example of an embodiment, the person holding unit comprises the ramp 32 and a guide arrangement extending in the region of the cage base 5 for the wheels of the wheelchair or stretcher chair. The person holding unit can be secured and/or retained by connecting the accessory connecting element 18 to the first receiving device 15. Furthermore, the pivoting doors in the corner region are illustrated in their open position so that virtually the full width of the cage front end 9 is available for accommodating the wheelchair or stretcher chair.

Accordingly, a person seated in a wheelchair or stretcher chair can be easily and effortlessly accommodated in the rescue cage as required. Additional aids such as the actuator 20 described above may be used for assistance.

The embodiments illustrated as examples represent possible variants of the rescue cage 4, and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

Above all, the individual embodiments of the subject matter illustrated in FIGS. 1; 2, 3, 4; 5; 6, 7, 8, 9 constitute independent solutions proposed by the invention in their own right. The objectives and associated solutions proposed by the invention may be found in the detailed descriptions of these drawings.

For the sake of good order, finally, it should be pointed out that, in order to provide a clearer understanding of the structure of the rescue cage 4, it and its constituent parts are illustrated to a certain extent out of scale and/or on an enlarged scale and/or on a reduced scale.

LIST OF REFERENCE NUMBERS

1 Hoisting rescue vehicle
2 Chassis
3 Turntable ladder
4 Rescue cage
5 Cage base
6 Cage barrier
7 Support element
8, 8', 8" Access opening
9 Cage front end
10 Left-hand cage side
11 Right-hand cage side
12 Cage rear end
13 Middle section
14 Middle handrail section
15 First receiving device
16 First connecting element
17 Accessory
18 Accessory connecting element
19 Upper receiving device
20 Actuator
21 First locking element
22 Second locking element
23 Locking mechanism
24 Plug-in pin
25 Centering shoulder
26 End face
27 Shoulder
28 Sleeve
29 Flange
30 Upright
31 Coupling device
32 Ramp
33 Locking mechanism
34 Auxiliary element
42 Left handrail section
44 Right handrail section
46 Left folding door
48 Right folding door

The invention claimed is:

1. A rescue cage for a hoisting rescue vehicle, the rescue cage comprising:

(a) a cage base having an outer peripheral region;

(b) a cage front end connected to the cage base;

(c) a left-hand cage side connected to the cage base;

(d) a right-hand cage side connected to the cage base;

(e) a cage rear end connected to the cage base;

wherein the cage front end, the left-hand cage side, the right-hand cage side and the cage rear end form a cage barrier, wherein the cage barrier comprises at least one first support element projecting out from the cage base and being disposed in the outer peripheral region of the cage base, wherein the at least one first support element has a first end facing the cage base and a plug-in pin, the plug-in pin being connected to the first end of the at least one first support element;

(f) at least one first receiving device comprising a sleeve provided or disposed on the cage base in a region of the at least one first support element; and (g) an accessory comprising at least one accessory connecting element;

wherein the plug-in pin is detachably connected to the sleeve, and wherein the sleeve is detachably connected to the at least one accessory connecting element of the accessory after detachment of the at least one support element and the plug-in pin from the sleeve;

wherein a front barrier section of the cage barrier comprises at least three front handrail sections, the three front handrail sections comprising a right handrail section, a left handrail section, and a middle handrail section; and wherein the right handrail section and the left handrail section are configured to pivot up and out of an access opening located in said cage front end after disengaging from the middle handrail section.

2. The rescue cage according to claim 1, further comprising a locking mechanism formed by a first locking element and a second locking element engaged with one another;

wherein the first locking element is disposed or provided on the plug-in pin and the second locking element is provided on the sleeve, or the first locking element is disposed or provided on the at least one accessory connecting element of the accessory and the second locking element is disposed or provided on the sleeve; and wherein the first and second locking elements are configured to engage with one another when the plug-in pin and the sleeve or the accessory connecting element and the sleeve are in a mutually connected position.

3. The rescue cage according to claim 1, further comprising at least one spacer element;

wherein the sleeve is configured to be detachably connected to the at least one accessory connecting element of the accessory with the at least one spacer element connected in between.

4. The rescue cage according to claim 1, further comprising a second receiving device;

wherein the sleeve and the second receiving device are mutually spaced apart.

5. The rescue cage according to claim 4, wherein the cage barrier further comprises a second support element, wherein the second support element is attachable to the second receiving device, and wherein the first and second support elements are connectable to one another by the middle handrail section extending between the first and second support elements.

6. The rescue cage according to claim 1, wherein the at least one support element has a second end remote from the cage base and a second receiving device in a region of the second end.

7. The rescue cage according to claim 1, wherein the access opening extends from the at least one first support element into a region of the left-hand cage side or a region of the right-hand cage side.

8. The rescue cage according to claim 1, further comprising at least one actuator.

9. The rescue cage according to claim 8, further comprising a coupling device;

wherein the actuator is detachably connected to the accessory by the coupling device.

10. The rescue cage according to claim 1, wherein the accessory is selected from the group consisting of ramps and person holding units.

11. The rescue cage according to claim 1, wherein the accessory comprises a person holding unit having a detachable ramp.

12. The rescue cage according to claim 11, wherein the ramp is of a pivotable design.

13. The rescue cage according to claim 12, further comprising a locking mechanism;

wherein the ramp has a plurality of pivoted positions and is lockable in at least one of the pivoted positions by the locking mechanism.

14. A hoisting rescue vehicle comprising:

(a) a chassis;

(b) a turntable ladder having a ladder set or a telescopic or articulated mast having a ladder set; and (c) the rescue cage according to claim 1, wherein the rescue cage is retained on an end of the ladder set remote from the chassis.

* * * * *